United States Patent [19]

Donovan et al.

[11] Patent Number: 5,043,207

[45] Date of Patent: Aug. 27, 1991

[54] THERMALLY INSULATING CONTINUOUS FILAMENTS MATERIALS

[75] Inventors: James G. Donovan, Norwell; John Skelton, Sharon, both of Mass.

[73] Assignee: Albany International Corp., Albany, N.Y.

[21] Appl. No.: 573,293

[22] Filed: Sep. 21, 1990

[30] Foreign Application Priority Data

Oct. 10, 1988 [GB] United Kingdom ..... 8823704

[51] Int. Cl.[5] ..... D04H 1/58

[52] U.S. Cl. ..... 428/226; 428/221; 428/903; 428/288; 428/920; 428/245; 428/296

[58] Field of Search ..... 428/221, 224, 280, 284, 428/226, 903, 288, 920, 245, 296

[56] References Cited

U.S. PATENT DOCUMENTS

| | | | |
|---|---|---|---|
| 3,423,793 | 1/1969 | Anger | 425/191 |
| 3,423,795 | 1/1969 | Watson | 19/66 T |
| 4,364,996 | 12/1982 | Sugiyama | 428/369 |
| 4,529,481 | 7/1985 | Yoshida et al. | 428/401 |
| 4,588,635 | 5/1986 | Donovan | 428/297 |
| 4,726,987 | 2/1988 | Trask et al. | 428/287 |

FOREIGN PATENT DOCUMENTS 1245437 9/1971 United Kingdom .

*Primary Examiner*—George F. Lesmes
*Assistant Examiner*—Beverly A. Pawlikowski
*Attorney, Agent, or Firm*—Kane, Dalsimer, Sullivan, Kurucz, Levy, Eisele & Richard

[57] ABSTRACT

Insulating material comprising continuous filaments of a synthetic material characterized in that the filaments have a mean diameter of from 4 to 20 microns and in that the filaments have been separated by a stretching and subsequent relaxation of a crimped tow of said filaments.

9 Claims, 2 Drawing Sheets

Figure 1:
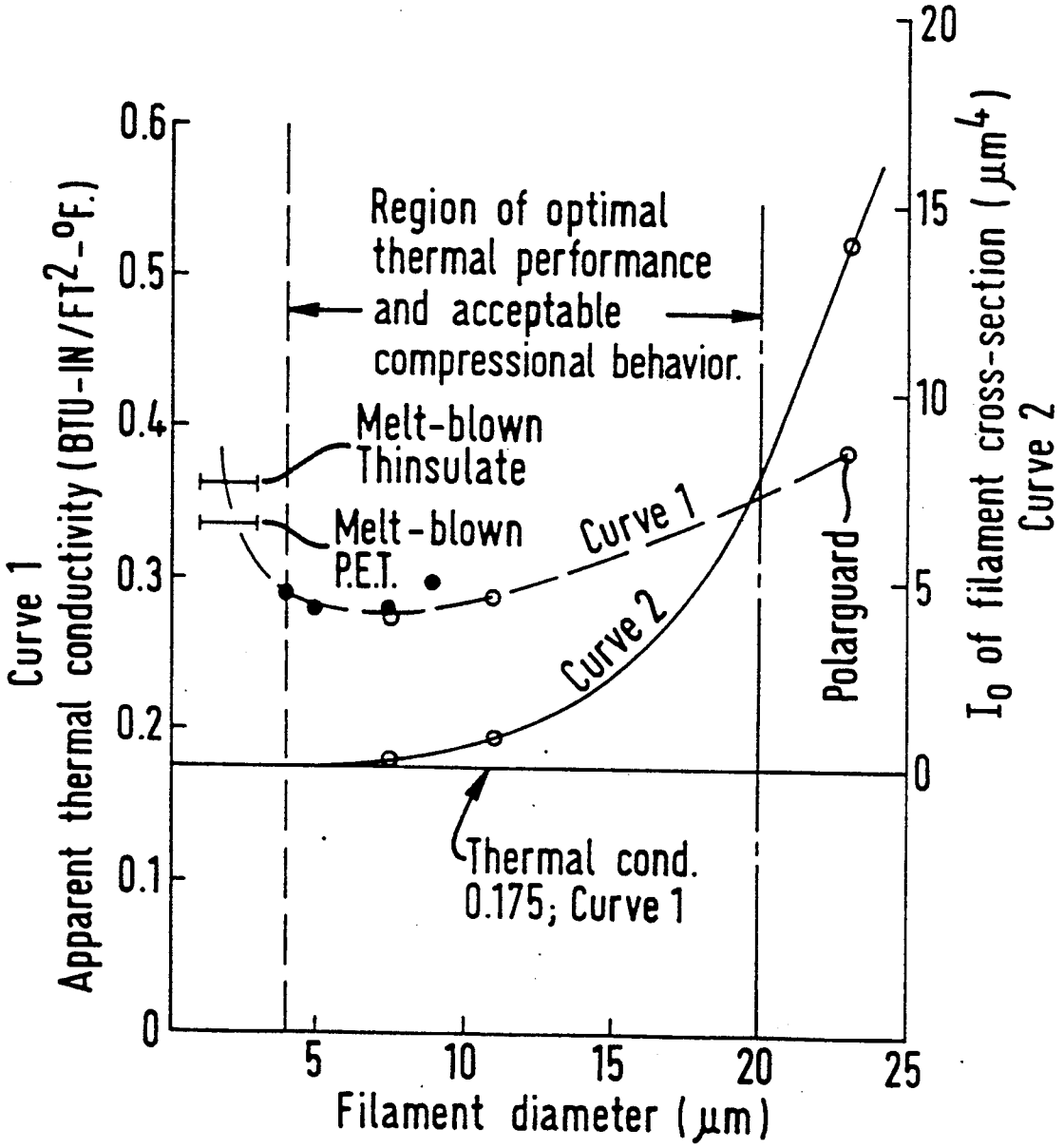

FIG. 1 Apparent thermal conductivity and polar moment ($I_0$), each as a function of filament diameter.

THERMALLY INSULATING CONTINUOUS FILAMENTS MATERIALS

The U.S. Government has rights in this invention pursuant to Contract No. DAAK60-87-C-0061 awarded by the Department of the Army.

DESCRIPTION

This invention relates to insulation materials and has particular reference to insulation materials suitable for use in sleeping bags and clothing in which insulation is produced from a continuous filament tow.

Continuous filament insulation material is well known and commercially available in the marketplace under the trade name "POLARGUARD". This material has outstanding mechanical performance, but it's thermal performance is significantly poorer than the best available synthetic thermal insulating materials. POLARGUARD is a continuous filament polyester tow with individual filaments having a diameter of approximately 23 microns. A significant advantage of a continuous filament construction is that the resulting web of filaments has a high degree of mechanical integrity that is achieved by the inherent high connectivity of the web. This mechanical integrity is an extremely valuable asset since it facilitates the handling of the web in any subsequent manufacturing process. Furthermore, it makes possible the use of shingle construction techniques in the assembly of sleeping bags and insulating clothing which eliminates cold spots that usually exist at quilting lines.

It is generally well known that the insulating properties of fibrous material improve with reducing diameter of the fibres until an optimum fibre diameter is reached; thereafter further reduction in the diameter of the fibres results in a decrease in the thermal performance of the material. For polyester material, the same material as used in POLARGUARD, a diameter of approximately 6 microns is the optimum for maximum insulating properties and at any fibre diameter greater than this, the thermal insulation properties decrease with increasing fibre diameter. At diameters which are more than three times this minimum, the thermal performance of fibrous insulation material starts to deteriorate quite significantly.

One of the problems with high loft continuous filament insulators such as, for example, POLARGUARD, is that because they are composed generally of macrofibres of the order of 23 micron diameter or approximately 5.5 dtex (5 denier), they are less efficient as insulators and are much stiffer in compression, than, for example, natural down. This compressional stiffness is a distinct disadvantage in service since, for example, sleeping bags containing commercial, high loft insulators cannot be packed into a small volume that will accommodate similar bags of natural down.

As is well known, the natural down obtained from water fowl consists of fibres having a range of diameters; these can be classified as microfibres contributing the principal insulation efficiency, and macrofibres providing desirable compressional and lofting characteristics. It is the interaction of the two that provides the unique properties of natural down. The present Applicants have appreciated this and have developed a synthetic fibre insulating material which is now commercially available under the trade name "PRIMALOFT". This material is described in detail in U.S. Pat. No. 4,588,635. In this material, the thermal performance is achieved by the use of small diameter fibres with the addition of small fractions of larger diameter fibres and/or bonding agents to enhance the mechanical behaviour.

It will be appreciated by the man skilled in the art that if the fibre material is continuous in nature, then there is less need to rely upon larger diameter fibres for the maintenance of the mechanical properties.

The relatively large diameter polyester fibres used in the POLARGUARD material result in an overall thermal performance significantly below that of the "PRIMALOFT" type material formed, for example, by the methods and techniques described in U.S. Pat. No. 4,588,635. Hence there is a considerable advantage in producing a continuous filament insulator having enhanced thermal properties over and above that of the traditional materials such as "POLARGUARD" referred to above and which at the same time can be packed into a smaller volume.

According to one aspect of the present invention, there is provided an insulating material comprising continuous filaments of a synthetic material characterised in that the filaments have a mean diameter of from 4 to 20 microns and in that the filaments have been separated by a stretching and subsequent relaxation of a crimped tow of said filaments.

According to another aspect of the present invention, there is provided an insulating material comprising continuous filaments of a synthetic material characterised in that the filaments have a mean filament diameter of 0.7 to 3.3 times the diameter of the filament at which conditions of minimum thermal conductivity occur in a batt of material at given density and in that the filaments have been separated by a stretching and subsequent relaxation of a crimped tow of said filaments.

In a particular embodiment of the present invention, the filament is a polyester filament of 0.9 to 2.1 dtex or 0.8 to 1.9 denier (9 to 14 micron).

It will be appreciated that the filaments will need to be of a size sufficient to confer the mechanical properties necessary to withstand normal wear and tear and laundering, and at the same time to confer sufficient mechanical properties to enable the tow to undergo successfully the spreading process.

In a particular aspect of the present invention, the tow may be separated by air spreading in the manner described in U.S. Pat. No. 3,423,795, the spreading being affected in a plurality of stages in each of which the tow is spread to a greater width than in the preceding stage.

In a particular aspect of the present invention the filament may be spread to form a batt having:

(i) a radiation perameter defined as intercept on the ordinate axis at zero density of a plot of $K_c P_F$ against $P_F$ less than 0.212 (W/m-K)(kg/m$^3$) [0.092(Btu-in/hr-ft$^2$-°F.)(lb/ft$^3$)]

(ii) a density $P_F$ from 3.2 to 13.0 kg/m$^3$ (0.2 to 0.8 lb/ft$^3$) and (iii) an apparent thermal conductivity $K_c$ measured by the plate to plate method according to ASTM C518 with heat flow down of less than 0.052 W/m-K (0.36 Btu-in/hr-ft$^2$-F.°).

The batt material in accordance with the invention may have a density of from 3.2 to 13 Kg/m$^3$ (0.2 to 0.8 lb/ft$^3$ and apparent thermal conductivity $K_c$ as measured by the plate to plate method according to ASTM C518 with a heat flow down, of less than 0.052 W/m-K (0.36 Btu-in/hr-ft$^2$-°F.) preferably less than 0.043 W/m-K (0.30 Btu-in/hr-ft$^2$-°F.) In another aspect of the invention the density of the batt structure may be within the range the range 3.2 to 16 kg/m$^3$ (0.2 to 1.0 lb/ft$^3$).

It is preferred that the resultant fibre structure has a radiation parameter defined as the intercept on the ordinate axis at zero density of a plot of $K_cP_F$ against $P_F$ less than 0.212 (W/m-K)(kg/m$^3$) [0.092(Btu-in/hr-ft$^2$-°F.)(lb/ft$^3$)] and a density $P_F$ from 3.2 to 13.0 kg/m$^3$ (0.2 to 0.8 lb/ft$^3$) and an apparent thermal conductivity $K_c$ measured by the plate to plate method according to ASTM C518 with a heat flow down of less than 0.052 W/m-K (0.36 Btu-in/hr-ft$^2$-°F.).

Continuous filaments particularly suited for use in the present invention may be selected from polyester, nylon, rayon, acetates, acrylics, modacrylics, polyolefins, polyaramids, polyimides, fluorocarbons, polybenzimidazols, polyvinylalcohols, polydiacetylenes, polyetherketones, polyimidazols and phenylene sulphide polymers such as those commercially available under the trade name RYTON.

Some materials, such for example as polyphenylene sulphide fibres, aromatic polyamides of the type commercially available under the trade name "APYIEL", and polyimide fibres such as those manufactured and sold under the reference P84 by Lenzing AG of Austria, exhibit flame retardant properties or are non-flammable. Such materials can, therefore, confer improved flame or fire resistant properties on manufactured products containing the materials in accordance with the present invention.

The bonding in the structures in accordance with the invention may be between the fibres at their contact points. The purpose of the bonding is to enhance the support for, and stiffness within the structure, thus enhancing significantly the mechanical properties of the insulating material.

This fibre to fibre bonding will, of course, increase the stiffness to an extent that the insulating material will have an enhanced resistance to compression and will begin to approach the mechanical properties of established material such, for example, as POLARGUARD referred to above. In this case, however, the improved insulation properties still show a significant advantage over the prior art material.

Any means of bonding between the macrofibres may be employed such, for example, as by the addition of solid, gaseous or liquid bonding agents whether thermoplastic or thermosetting or by the provision of autologous bonds in which the fibres are caused to bond directly through the action of an intermediary chemical or physical agent.

The method of bonding is not critical, subject only to the requirement that the bonding should be carried out under conditions such that the fibre component, does not lose its structural integrity. It will be appreciated by one skilled in the art that any appreciable change in the fibres of the batt during bonding will affect the thermal properties adversely; the bonding step needs, therefore, to be conducted to maintain the physical properties and dimensions of the fibre components and the assemblage as much as possible.

In a particular embodiment of the present invention bonding within the structure may be effected by heating the assemblage of fibres for a time and at a temperature sufficient to cause the fibres to bond.

In a particular embodiment of the present invention bonding within the structure may be effected by spraying the top and bottom of the batt with an acrylic latex emulsion (methylacrylate), Rohm and Haas No. TR407, and then drying and curing the latex by passing the sample through a 240° F. oven with a dwell time of 8 minutes. The dry weight add-on of the latex adhesive component is about 10%.

The presence of the crimp in the tow material should be such that the material has a primary crimp within the range of 3 to 10 crimps/cm (8 to 26 crimps per inch) and a secondary crimp of 0.5 to 2 crimps/cm (2 to 5 crimps per inch).

Following is a description by way of example and with reference to the accompanying drawings of methods of carrying the invention into effect.

In the drawings

FIG. 1 is a plot of apparent thermal conductivity and polar moment as a function of fibre diameter for several insulator examples.

Figure 2:
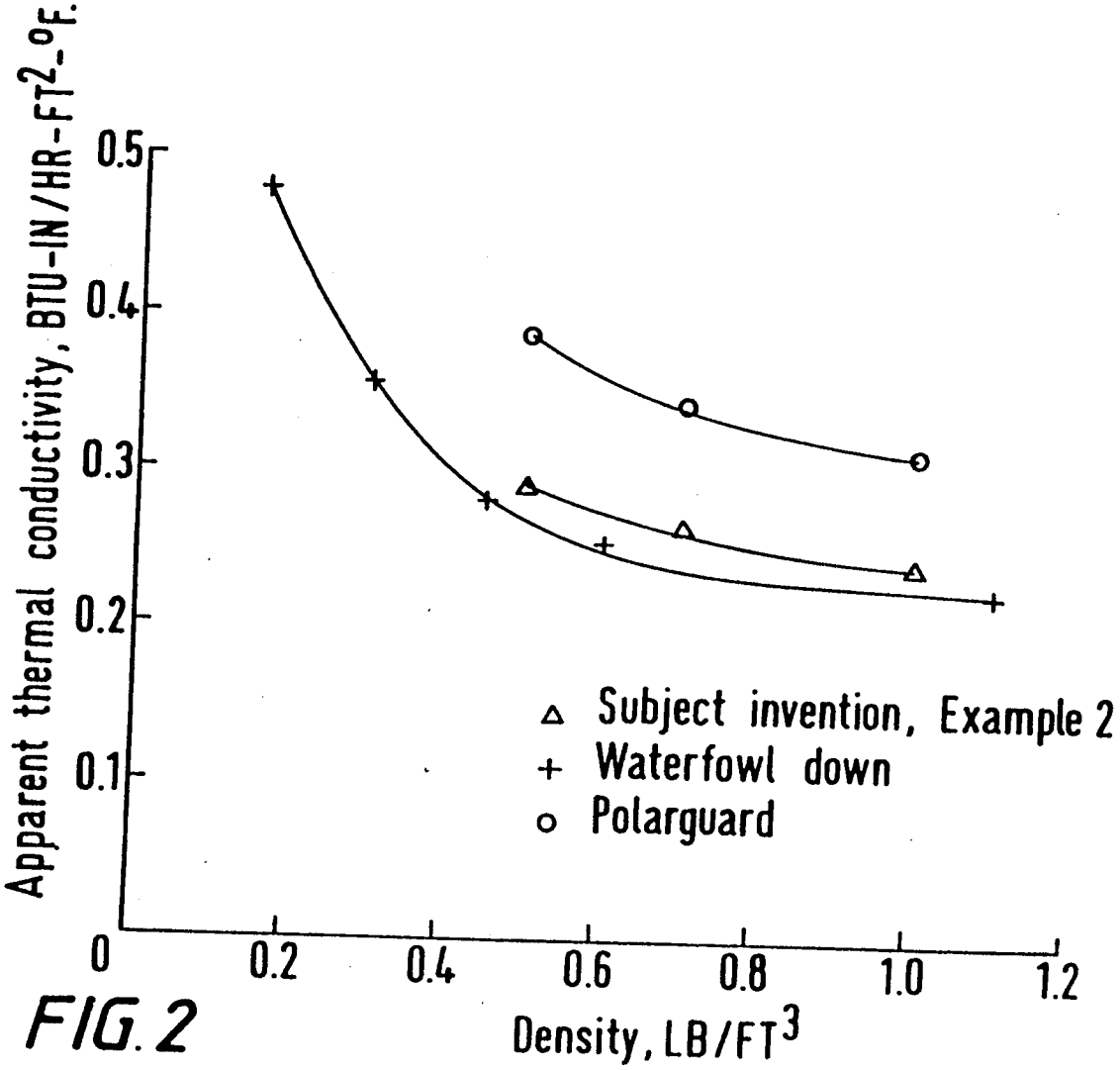

FIG. 2 is a plot of apparent thermal conductivity as a function of density for several insulator examples The relationships between the thermal and the mechanical properties of low density insulators and the diameter of the component filaments are illustrated in FIG. 1. Curve 1 represents the thermal behavior of the filament assembly and the scale and units appropriate to this plot are found on the vertical axis on the left hand side of the figure. The data is derived from three distinct filament configurations, but there is a clear continuity in the behavior, and we believe that the plot represents a single phenomenon which is to a large extent independent of the details of the assembly. The three experimental points shown as open circles are for the commercial product POLARGUARD (23 micron filament diameter) and for two embodiments of the present concept. All three are arrays of continuous filament polyester, and the assembly of 7.5 micron diameter filaments appears to be close to the limit of present manufacturing technology, though it seems probable that this limit could be extended to lesser filament diameters if the need arose. The four experimental points shown as closed circles are for assemblies of polypropylene staple fibres. This polymer was chosen because of the relative ease with which it is possible to produce small diameter fibres, and the fibre assemblies were produced from crimped, cut and carded fibres because of the difficulty of using existing technology to produce low density assemblies from extremely fine filaments by the tow-spreading process. The final two experimental points are for melt blown assemblies: one is for an experimental array of polyester and the other is for the commercial product trade-named THINSULATE which consists mainly of polypropylene. The melt blown assemblies have distributions rather than single values for filament diameter, with most of the filaments having diameters in the 1–3 micron range. These fine filament assemblies are not readily available in the very low density range, because of their extreme propensity to compressional collapse so the effective thermal conductivity values for these two materials were measured at higher densities (16 to 24 kg/m$^3$ or 1 to 1.5 lb/ft$^3$) and the measured values were normalized according to the protocol discussed in U.S. Pat. No. 4,588,635 to correspond to all others shown, which were measured at batt densities of 8.0 kg/m$^3$ (0.5 lb/ft$^3$). There is a high degree of connectivity in those melt blown assemblies, and they provide a reasonable analogue of the continuous filament arrays in the small diameter range.

The entire curve shown by the dashed line in FIG. 1 contains data for two separate polymer materials and three distinct production techniques; nevertheless the data shows a remarkable degree of overlap and continuity at the transitions, and we believe, with strong theoretical justification, that the curve represents a single performance characteristic of filament assemblies, with a strong independence of polymer material and assembly fine structure. The factor that is brought out most strongly by this curve is the fact that there is a distinct minimum in the thermal conductivity of the assembly, or, alternatively stated, an optimum range of filament diameter for thermal insulation performance. Moreover, it is clear that the commercially available POLARGUARD is demonstrably non-optimal in the high range of filament diameters, and the quasi-continuous melt blown material typified by THINSULATE is non-optimal in the low filament diameter range. The present invention is intended to lie in the filament diameter range between these two extremes where there are signficiant gains to be realized in thermal performance. The magnitude of these improvements can be best seen by comparing the contributions to thermal conductivity which are solely attributed to the fibre component of the assembly. This is done conceptually by shifting the horizontal axis of the plot up to the level of the immutable component of apparent thermal conductivity which is attributable to the conductivity of the air contained in the assembly. Using this line as a basis for calculation it can be seen that the filament contribution for the THINSULATE is approximately 90% and for the POLARGUARD is approximately 110% greater than the contribution for the optimal filament assembly of the present patent, and this represents a significant improvement in thermal insulation performance over both these commercial embodiments.

The mechanical performance characteristics shown by Curve 2 of FIG. 1 (solid line) are equally illuminating, and the scale and units appropriate to this plot are found on the vertical axis on the right hand side of the Figure. The property that is plotted here is the polar moment of area, which is a measure of the influence of the geometrical dimensions of the filament on its bending properties. A low value corresponds to a very limp and flexible filament, and a high value corresponds to a stiff fibre, and these filament differences are reflected in the compressive behavior of the filament assembly. The individual points are calculated for the same filament diameters as were used in Curve 1 for the three continuous filament insulators.

For small filament diameters this moment of area is small, and the filaments are extremely flexible and show only minimal resistance to bending. As was discussed above, the melt blown assemblies reflect this filament property, and they are so responsive to compressive loading that they collapse under small stresses and it is impossible to maintain a lofty, low density assembly of these materials. The polar moment of area is a rapidly-increasing function of filament diameter, and for diameters greater than 20 microns a polyester filament shows a considerable resistance to bending. This resistance is so high, in fact, that POLARGUARD, which is an assembly of 23 micron diameter filaments, is extremely resistant to compressional deformation, and is not totally suitable for use in sleeping bags in which packability is a requirement. Thus, as with the thermal properties, there is a range of filament diameters which are most suited for a lofty, insulation material; at low filament diameters the lofty assembly is not sustainable under normal use loadinqs; and at high filament diameters the compressional stiffness is so high that the packability is compromised. The range of optimal filament diameter, which includes the example of this invention, is shown in FIG. 1. Not all of this range can be covered by current tow-spreading processing technology. As might be expected on the basis of the preceding discussion, the ability to form a lofty spread tow by manipulation of bent filaments is clearly related to the filament diameter, and the large filament tow that becomes POLARGUARD is relatively simple to process. As the filament diameter is decreased into the range of the present invention the tow becomes more difficult to spread and at diameters around 8 microns the current process becomes uncommercially slow and marginally effective on a routine basis. Nevertheless, the potential benefits of working within the appropriate range for optimizing both thermal and mechanical performance are clearly demonstrated by FIG. 1. As was described earlier, these measurements were made on assemblies with densities of 0.5 lbs/ft$^3$, but FIG. 2 demonstrates that this functional superiority is maintained over the entire range of densities that are of interest for high loft insulation materials (0.2 to 0.8 lb/ft$^3$).

In summary, the discussion presented above demonstrates, with reference to the plots of FIG. 1 that the inventive step of selecting filament diameter in the appropriate range leads to significant improvements in the performance of continuous filament insulators. On the basis of the information of FIG. 1 the lower and upper limits for optional insulator performance are set as 4 microns and 20 microns respectively these limits have sound theoretical and experimental bases and effectively define the three regions of insulator design philosophy which are represented by: (1) melt-blown materials having fibre diameters $<4$ microns, (2) the materials of the present invention having diameters in the 4 to 20 microns range, and (3) conventional, high-loft, large diameter, continuous-filament insulators typified by POLARGUARD having diameters $>20$ microns.

In the following examples where reported the following tests were employed:

Density: The volume of each insulator sample was determined by fixing two planar sample dimensions and then measuring thickness at 0.014 kPa (0.002 lb/in$^2$) pressure. The mass of each sample divided by the volume thus obtained is the basis for density values reported herein.

Apparent thermal conductivity was measured in accord with the plate/sample/plate method described by ASTM Method C518.

Radiation Parameter, C was calculated from the expression:

$$C = K_c P_F - K_a P_F$$

where $K_c$ = apparent thermal conductivity of the material, $P_F$ = density of the material, and $K_a$ = the thermal conductivity of still air.

= 0.025 $W/m\text{-}K$ (0.175 Btu-in/hr-ft$^2$-°F).

Compressional Strain: Strain at 34.4 kPa (5 lb/in$^2$), which was the maximum strain in the compressional recovery test sequence, was recorded for each test.

Compressional Recovery and Work of Compression and Recovery: Section 4.3.2 of Military Specification MIL-B-41826E describes a compressional-recovery test technique for fibrous batting that was adapted for this work. The essential difference between the Military Specification method and the one employed is the lower pressure at which initial thickness and recovered-to-thickness were measured. The measuring pressure in the specification is 0.07 kPa(0.01 lb/in$^2$) whereas 0.014 kPa (0.002 lb/in$^2$) was used in this work.

EXAMPLE 1

A tow of continuous filament of polyester having a fine crimp of 7.1 crimps/cm (18 crimps per inch) superimposed on a crimp of much larger amplitude and frequency of 1 crimp/cm (2.5 crimps per inch) and having a denier of 0.5 (7.7 microns diameter) was subjected to an air spreading technique as described in U.S. Pat. No. 3,423,795.

The thermal insulation of the material obtained was significantly better by a factor greater than 2 to 1 than that of the prior art material commercially available under the trade name POLARGUARD.

EXAMPLE 2

A tow of continuous filament polyester having a fine crimp of 4.73 crimps/cm (12 crimps per inch) superimposed on a crimp of much larger amplitude and frequency of 1.2 crimps/cm (3 crimps/inch) and having a denier of 1.2 (11 microns diameter) was subjected to an air spreading technique as described in U.S. Pat. No. 3,423,795.

The air-spreading technique resulted in separation of the tow into a batt of continuous filaments which provided a very significant loft with good mechanical properties due to the interaction between the crimps and it was found that the mechanical properties of the resulting insulator material were such that the loft of the material were generally maintained after compression.

Furthermore, the thermal insulation of the material was significantly better by a factor of approximately 2 to 1 over and above the prior art material commercially available under the trade mark POLARGUARD. The material produced in the manner described above was eminently satisfactory for the production of sleeping bags having a shingle construction and the thermal insulation properties per unit weight were significantly improved.

Examples 1 and 2 of the subject invention are compared with the two samples of material obtained under the trade mark POLARGUARD and with a sample of duck down. The results are set out in Table 1 as follows:

TABLE 2

| Performance Property | Polarguard TM Army Sample | Polarguard TM (Hoechst) | MIL Spec[a] Duck Down | Example 1 of the Subject Invention | Example 2 of the Subject Invention |
|---|---|---|---|---|---|
| Thermal conductivity[b] | | | | | |
| (Btu-in/hr-ft$^2$-°F.) | 0.377 | 0.387 | 0.271 | 0.275 | 0.288 |
| W/m-°K. | 0.054 | 0.056 | 0.039 | 0.040 | 0.041 |
| Minimum density[c] | | | | | |
| (lb/ft$^3$) | 0.49 | 0.36 | 0.24 | 0.49 | 0.44 |
| Kg/m$^3$ | 7.85 | 5.77 | 3.85 | 7.85 | 7.05 |
| Compressional strain[d] at 4.4 kPa (5 lb/in$^2$) (%) | 95 | 95 | 95 | 96 | 95 |
| Compressional recovery from 4.4 kPa (5 lb/in$^2$) (%) | 87 | 119 | 102 | 79 | 96 |
| Work to compress to 4.4 kPa (5 lb/in$^2$) (lb-in) | 4.16 | 4.96 | 4.91 | 2.25 | 5.84 |
| N-m | 0.47 | 0.56 | 0.55 | 0.25 | 0.66 |
| Resilience | 0.63 | 0.53 | 0.53 | 0.68 | 0.44 |

[a]Per MIL-F-43097G, Type II, Class 1.
[b]Measured in accordance with ASTM C518, heat flow down, $T_1$ = 38° C. (100° F.), $T_2$ = 10° C. (50° F.)
Sample density = 8.02 Kg/m$^2$ (0.50 lb/ft$^3$)
[c]Minimum density is the density at maximum loft.
[d]All compressional properties obtained using a 2.00 inch (5.08 cm) gauge length with a density of 8.02 Kg/m$^2$ (0.50 lb/ft$^3$) at the 2.00 inch (5.08 cm) gauge distance.
[e]Resilience equals: work-of-recovery divided by work-to-compress.

The thermal conductivity of various samples of each material was measured by using samples 5.8 cm (2 inches) thick and the heat flow was measured downwards; the upper plate temperature was 38° C. (100° F.) and the lower temperature was 10° C. (50° F.). Nonwoven scrims of 17 g/m, (0.5 oz/yd$^2$) were placed on the top and bottom of each sample and the tests were carried out on a plate/sample/plate apparatus described by ASTM Method C518. The results were plotted in a graph as shown in FIG. 2.

We claim:

1. An insulating material comprising continuous filaments of a synthetic material wherein the filaments have a mean diameter of from 4 to 20 microns, wherein the filaments have been separated by a stretching and subsequent relaxation of a crimped tow of said filaments, wherein the material has a density of 0.2 to 1.0 lb/ft$^3$, wherein the material has an apparent thermal conductivity $K_c$ as measured by the plate to plate method according to ASTM C518 with a heat flow down of less than 0.36 Btu-in/hr-ft$^2$-°F.., and wherein the resultant fiber structure has a radiation parameter defined as the intercept on the ordinate axis at zero density of a plot of $K_cP_F$ against $P_F$ less than 0.092 (Btu-in/hr-ft$^2$-°F..)(lb/ft$^3$).

2. An insulating material comprising continuous filaments of a synthetic material wherein the filaments have a mean filament diameter of 0.7 to 3.3 times the diameter of the filament at which conditions of minimum thermal conductivity occur in a batt of material at a given density, and wherein the filaments have been separated by a stretching and subsequent relaxation of a crimped tow of said filaments.

3. An insulating material as claimed in claim 1 or claim 2 wherein the continuous filaments are selected from the group consisting of polyester, nylon, rayon, acetates, acrylics, modacrylics, polyolefins, polyaramids, polyimides, fluorocarbons, polybenzimidazols, polyvinylalcohols, polydiacetylenes, polyetherketones, polyimidazols and phenylene sulphide.

4. An insulating material as claimed in claim 1 or 2 wherein the filmanet comprises a polyester filament having a denier of 0.17 to 4.44 dtex (0.16 to 4.0 denier).

5. An insulating material as claimed in claim 1 or 2 wherein the tow is separated by air spreadhing, the spreading being effected in a plurality of stages in each of which the tow is spread to a greater width than in the preceding stage.

6. An insulating material as claimed in claim 1 or 2 having fire retardent properties wherein a significant proportion of the continuous filaments within the structure comprise filaments selected from the group consisting of polyphenylene sulphide fibres, aromatic polyamide fibres of the type commerically available under the trade name "APYIEL", and polyimide fibres.

7. An insulating material as claimed in claim 1 or 2 wherein the continuous filaments constituting the insulating batt structure are additionally bonded at least some of fibre to fibre contact points.

8. A structure as claimed in claim 1 or 2 wherein the tow material has a primary crimp within the range of 3 to 10 crimps/cm (8 to 26 crimps per inch) and a secondary crimp of 1 to 2 crimps/cm (2 to 5 crimps per inch).

9. An insulating material as claimed in claim 1 or 2 in the form of a batt.

* * * * *